US008545286B2

(12) United States Patent
Coleman

(10) Patent No.: US 8,545,286 B2
(45) Date of Patent: Oct. 1, 2013

(54) FOLDING PATTERN

(75) Inventor: Benjamin John Coleman, Providence, RI (US)

(73) Assignee: Benjamin John Coleman, Fall River, MA (US)

( * ) Notice: Subject to any disclaimer, the term of this patent is extended or adjusted under 35 U.S.C. 154(b) by 495 days.

(21) Appl. No.: 13/012,990

(22) Filed: Jan. 25, 2011

(65) Prior Publication Data

US 2011/0190106 A1 Aug. 4, 2011

Related U.S. Application Data

(60) Provisional application No. 61/301,011, filed on Feb. 3, 2010.

(51) Int. Cl.
*A63H 33/16* (2006.01)

(52) U.S. Cl.
USPC ..... 446/488

(58) Field of Classification Search
None
See application file for complete search history.

(56) References Cited

U.S. PATENT DOCUMENTS

| | | | | |
|---|---|---|---|---|
| D76,164 | S | | 8/1928 | Smith |
| 2,007,421 | A | | 7/1935 | Coughlin |
| 2,529,979 | A | | 11/1950 | Turnbull |
| D166,894 | S | | 5/1952 | Whitney |
| 2,633,657 | A | | 4/1953 | Warren, Jr. |
| 3,962,816 | A | * | 6/1976 | Sarid ..... 446/488 |
| 4,517,251 | A | * | 5/1985 | Mosely ..... 428/542.8 |
| 5,484,378 | A | | 1/1996 | Braithwaite |
| 5,842,630 | A | | 12/1998 | Remer |
| D407,663 | S | | 4/1999 | MacDonald |
| 5,947,885 | A | | 9/1999 | Paterson |
| 6,248,426 | B1 | | 6/2001 | Olson et al. |
| 6,497,601 | B1 | | 12/2002 | Ward |
| D469,481 | S | | 1/2003 | Lewis |
| 6,640,605 | B2 | | 11/2003 | Gitlin et al. |
| 7,219,871 | B2 | | 5/2007 | Hecker |
| D547,395 | S | | 7/2007 | Yaguchi |
| 2002/0168449 | A1 | | 11/2002 | Summers |
| 2007/0170230 | A1 | | 7/2007 | Redon |

FOREIGN PATENT DOCUMENTS

| | | |
|---|---|---|
| FR | 2828420 | 2/2003 |
| JP | 3009781 | 1/1991 |
| JP | 2003126567 | 5/2003 |
| JP | 2005087498 | 4/2005 |
| WO | 2009/002211 | 12/2008 |

* cited by examiner

*Primary Examiner* — John Ricci

(57) ABSTRACT

In its simplest form, the invention is an array of 10 triangles arranged in a specific pattern. When arranged in this pattern, these triangles interact in a unique way, such that a new useful three-dimensional shape emerges. When this pattern of triangles is applied to any flat material, either through folding, impressing, affixation of hinges, or some other method, the formerly flat material can be manipulated to become a durable, three-dimensional hinged appendage.

20 Claims, 6 Drawing Sheets

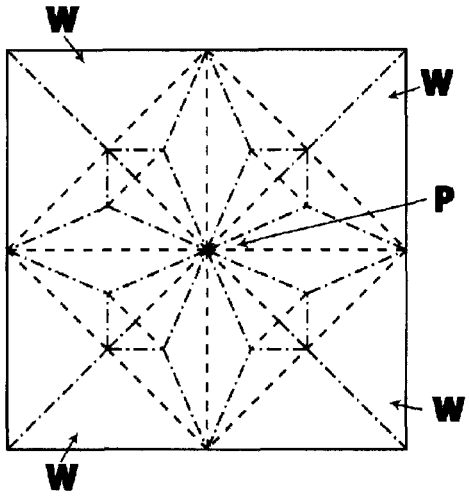
FIG. 1
FIG. 2
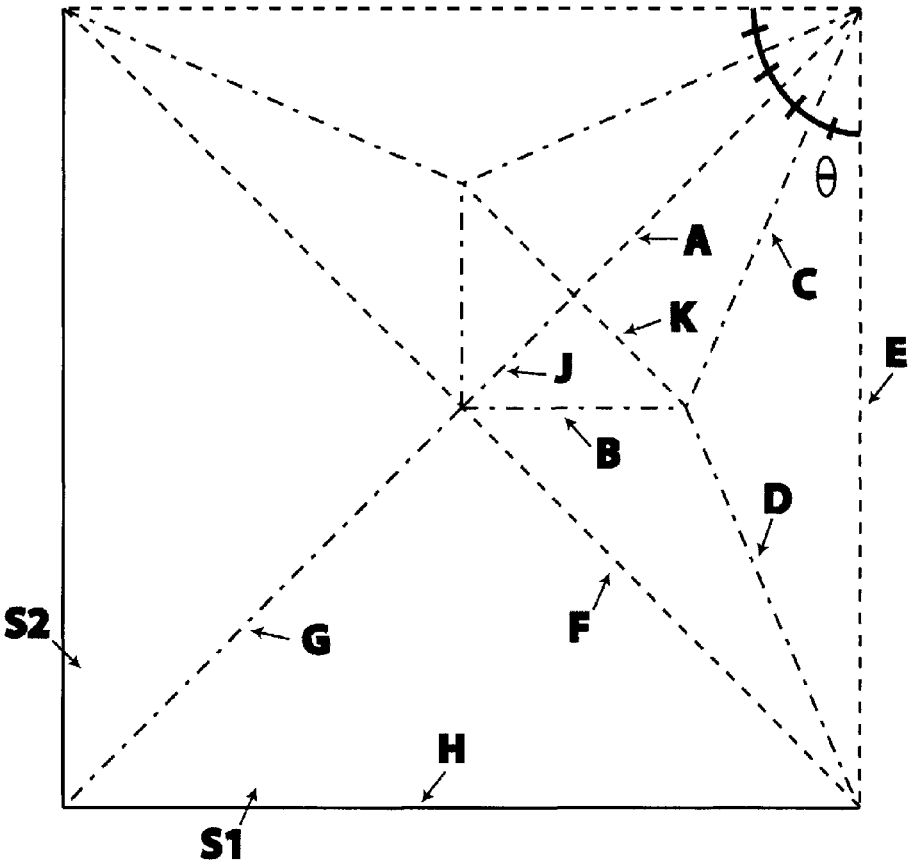

A, B, F, J and K are hidden within the invention.

FOLDING PATTERN

RELATED CASES

Priority for this application is hereby claimed under 35 U.S.C. §119(e) to commonly owned and U.S. Provisional Patent Application No. 61/301,011 which was filed on Feb. 3, 2010 and which is incorporated by reference herein in its entirety.

FIELD OF THE INVENTION

The present invention relates to a folding pattern for forming, from a single sheet of material, a three dimensional structure. The present invention also relates to a method of folding a single sheet of material in order to form a three dimensional structure.

BACKGROUND OF THE INVENTION

There are several existing patents that relate to different techniques for folding a sheet material into a three dimensional object. The following are examples of some uncovered prior art:

U.S. Pat. No. 5,842,630 issued to Remer reveals a pattern of folds which produce a pyramid shape. The pyramid shape may be used for the storage of three-dimensional objects. U.S. Pat. No. D166,894 issued to Whitney describes a highly curved, open-topped container for items like cosmetics. With regards to the Remer and Whitney patents, it is noted that the folding patterns shown in these references is relatively simple and directed to the use of the object for storage.

U.S. Pat. No. D407,663 issued to MacDonald describes an ornamental design for an ornament. It represents a relatively simple array of curves, created by bending the medium and then securing to a center point. The MacDonald ornament involves curved surfaces whereas the concepts of the present invention relate to an array of flat triangular planes.

U.S. Pat. No. D469,481 issued to Lewis, U.S. Pat. No. D547,395 issued to Yaguchi, describes the construction of an ornamental origami toy. U.S. Pat. No. 2,529,979 issued to Trunbull describes the creation of an origami toy aircraft.

The Lewis, Yaguch, and Trunbull patents are for specific ornamental shapes described as "toys" and not the folding pattern of the present invention.

U.S. Pat. No. D76,164 issued to Smith is described as a paper bird puzzle which is created from a square of paper which is then folded using the origami technique. U.S. Pat. No. 2,007,421 issued to Coughlin is a more complex puzzle. U.S. Patent Publication No. 2002/0168449A1 issued to Summers describes a flavored sheet which is then folded into a three-dimensional shape intended to be educational. The Smith, Coughlin and Summers patents are intended to be used as educational puzzles.

U.S. Pat. No. 5,484,378 issued to Braithwaite describes a method for the production of a folded shape starting with a flat circular flexible material. The material is inserted into a complex array of triangular planes. Folds are somehow impressed into the material which can then be further processed into a decorative symmetrical object.

Braithwaite's decorative symmetrical object bears no resemblance to the concepts of the present invention. Most importantly, it is based on a circular-shaped material, and lacks the complexity of triangular planes incorporated into the present invention.

U.S. Pat. No. 6,497,601 B1 issued to Ward and U.S. Pat. No. 6,248,426 B1 issued to Olson et al. describe the creation of a pre-printed cube for advertising (Ward) or photo display (Olson et al.). The Ward and Olson patents are cube-shaped while the concepts of the present invention relates to a flat sheet material.

U.S. Pat. No. 7,219,871 B2 issued to Hecker describes the creation of an easel which holds advertising or photos. The Hecker patent is for an object designed to hold another object for visual purposes and therefore bears no similarity to the present invention.

U.S. Pat. No. 5,947,885 issued to Paterson describes a method and apparatus for folding sheet metals with tessellated patterns. U.S. Pat. No. 6,640,605 B2 issued to Gitlin et al. describes a method of bending sheet metal to form three-dimensional structures. The Paterson and Gitlin et al. patents describe methods and apparatus for performing folds, but does not teach the concepts of the present invention as they relate to using a new folding pattern that provides a sturdy three dimensional structure.

SUMMARY OF THE INVENTION

An object of the present invention is to provide a folding pattern in which a flat planar surface is converted into a sturdy three-dimensional structure that is basically comprised of an array of triangular planes. The present invention provides a scalable solution for applications including, but not limited to, ornamental and structural weight mass distribution and other applications. The basic pattern is modeled on a polygon in the planar surface cut into equal, congruent wedges. Each wedge is comprised of ten triangular shaped planes that interact with each other. Each set of ten triangular shaped planes moves, in an origami-style manner, to produce a durable hinged or folded structure.

In accordance with one embodiment of the present invention there is provided a folding pattern of sheet material having multiple side edges wherein the sheet material is foldable to form a three dimensional structure, the folding pattern defined by a plurality of triangles each having joined sides. A diagonal demarcation line separates the sheet material into separate but adjacent segments that each are a mirror image of the other, each the segment being comprised of five adjacently disposed triangles, including a first triangle, a second triangle having one side in common with a side of the first triangle, a third triangle having one side in common with another side of the second triangle, a fourth triangle having one side in common with another side of the third triangle, and a fifth triangle having one side in common with another side of the fourth triangle.

In accordance with other aspects of the present invention the first triangles of respective separate segments form a valley fold; the second and fifth triangles of each segment form respective valley folds; the third and fourth triangles form at least part of a mountain fold; the third and fourth triangles of both segments form a mountain fold; the same angle theta is formed at the fourth and fifth triangles measured from a centerpoint; another side of the fourth triangle is equal in length to another side of the fifth triangle; the one side of the third triangle is equal in length to the one side of the fourth triangle; the plurality of triangles form a first wedge, and further including at least a second wedge that is substantially the same as the first wedge and is contiguous therewith; including four wedges in a square pattern; the sheet material is one of paper, metal or some other material; the triangles are interconnected by one of folds or hinges.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 1 is an illustration of one embodiment of the present invention using four wedges in a square sheet material pattern;

FIG. 2 illustrates one of the wedges of FIG. 1;

FIG. 17 shows an octagon wherein G is greater than A+J with four appendages;

DETAILED DESCRIPTION

An objective of the present invention is to provide a folding pattern in which a flat planar surface is converted into a sturdy three-dimensional structure that is basically comprised of an array of triangular planes. The present invention provides a scalable solution for applications including, but not limited to, ornamental and structural weight distribution and other applications. The basic pattern is modeled on a polygon in the planar surface cut into equal, congruent wedges. Each wedge (see FIG. 1 and the use of four wedges) is comprised of ten triangular shaped planes that interact with each other. Each set of ten triangular shaped planes moves, in an origami-style manner, to produce a durable hinged or folded structure.

The principles of the present invention are described herein primarily in connection with Origami. However, the principles described herein may be used for forming any number of different three dimensional structures, particularly ones that are characterized by a substantial strength once formed.

Figure 18:
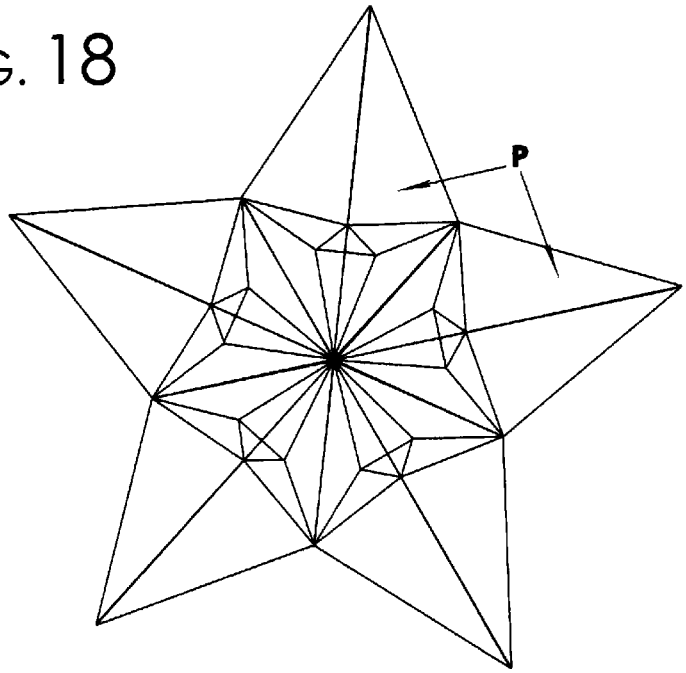
FIG. 18 illustrates a five wedge folding pattern.
Figure 19:
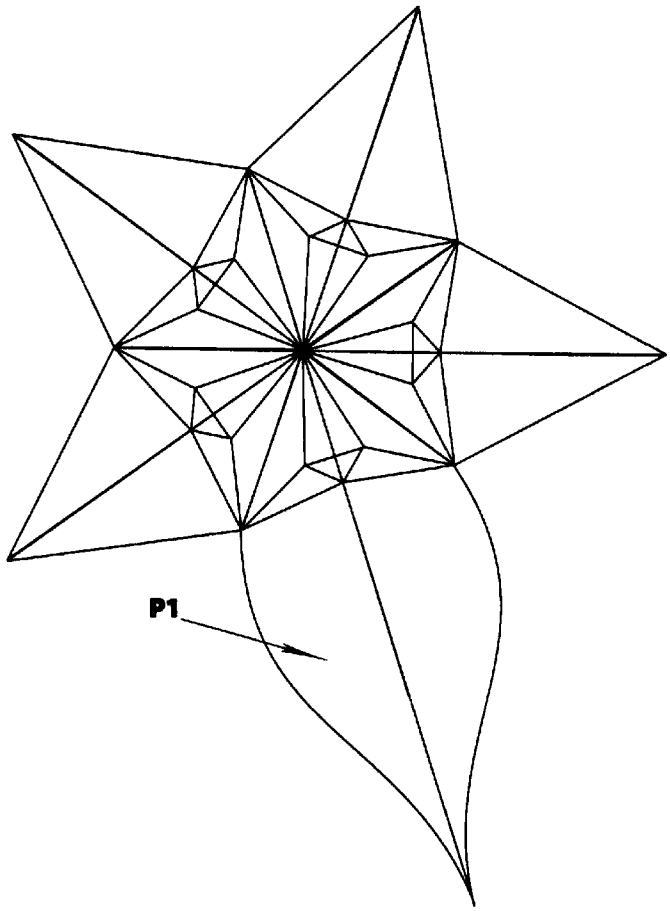
FIG. 19 illustrates the pattern of FIG. 18 with an alternate triangle configuration.

When reference is made herein to a "fold" it is meant to cover, not only a fold as in a piece of paper or thin metal sheet, but also is meant to cover any type of a hinge or pivot member or mechanism that enables folding. Also, when reference is made to a "triangle", the interpretation should be taken broadly to cover, not only classic triangles, all with linear sides, but also to cover triangles in which at least one side thereof is non-linear, such as shown in FIG. 19 herein. Reference to a wedge refers to a part of the overall pattern, such as shown in FIG. 1 wherein four wedges are used in the square sheet material depicted. Each wedge has ten triangles. Plural wedges are used. However, any number of wedges may be employed. See FIGS. 18 and 19 for a folding pattern using five wedges.

FIG. 1 depicts a square polygon divided into four quadrants (wedges). Each wedge W is comprised of ten triangular shapes. FIG. 2 is a close-up view of the bottom left quadrant (wedge) shown in FIG. 1. Notice that each side of the center line AJG is a congruent mirror image of five triangular shapes. Thus, in FIG. 2 the square is separated by demarcation line G, J, A into separate segments S1 and S2. Dotted and then dashed lines represent folds that when folded, the line of folding moves toward the viewer and the surfaces surrounding it move away (commonly referred to as "mountain" folds). Dashed lines represent folds that when folded, the line of folding moves away from the viewer and the surfaces surrounding it move toward the viewer (commonly referred to as "valley" folds).

In FIG. 2 the line H corresponds to an edge of the material. The dimension H need not be a line as depicted in FIG. 2, but could be as illustrated in FIG. 19. The line H may be a curve, saw tooth, a shape with slots or other geometric shapes for connection, or some other shape. The line E becomes the height of the folded structure. The line or dimension G (plus a constant dependent upon the thickness of the material used) becomes the length (or radius if the invention is applied multiple times about a center point) of one appendage of the folded pattern.

The length of each side of each triangle can be calculated, based on the lettering of FIG. 2, as follows:

$$A=\sqrt{C^2-K^2}$$

$$B=\sqrt{J^2+K^2}$$

$$C=D=\sqrt{A^2+K^2}$$

$$E=2D\cos\theta$$

$$F=E\cdot\sin(2\theta)$$

In a four wedge configuration $$J=K=\sqrt{\frac{B^2}{2}}$$

G=Any value from zero to infinity and H is a function of G and F.

The square shown in FIG. 1 produces a four appendage shape that can be made in any size. The appendages are each formed from both segment S1 and S2 of triangle FGH. It would be made up of four of the arrays of triangles as described above, with each quadrant rotated 90°, 180°, and 270° about the center point P. Each appendage requires $$\frac{360^\circ}{4}=90^\circ.$$

In this example, in FIG. 2, $$\theta=\frac{90^\circ}{4}=22.5^\circ.$$

Figure 3:
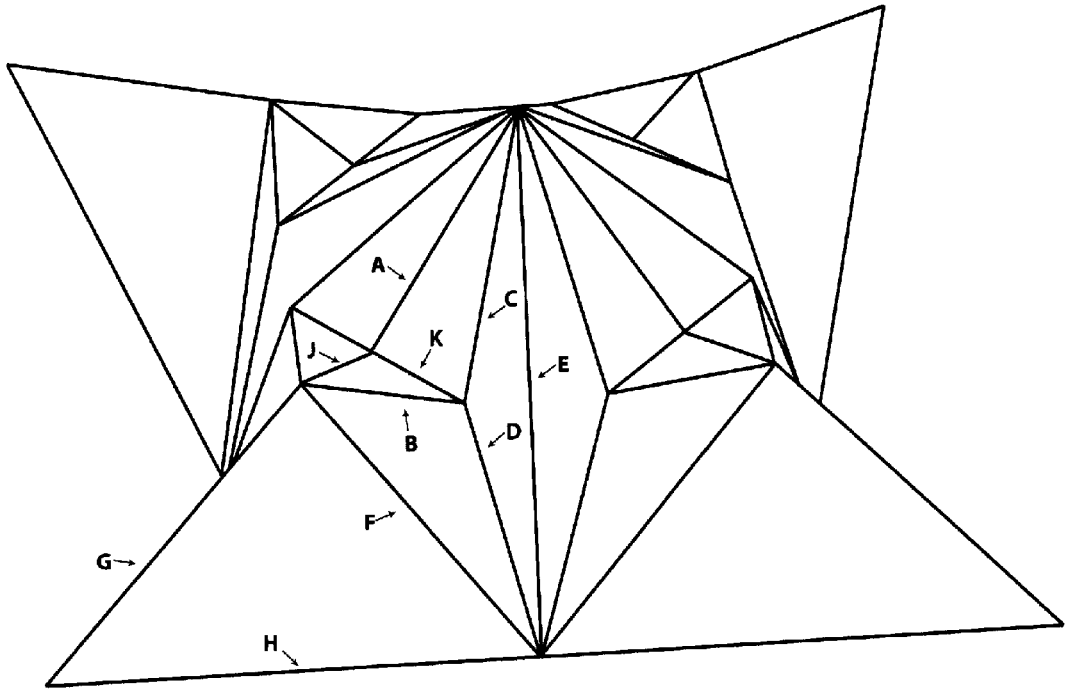
FIG. 3 shows how the triangular plates move as the arrays of triangles collapse into themselves.
Figure 4:
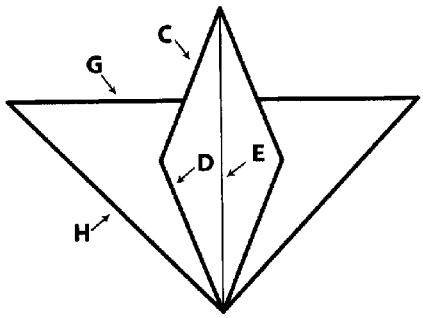
FIG. 4 illustrated the pattern of FIG. 3 when fully formed.

FIG. 3 shows how the triangular planes move as the arrays of triangles collapse into themselves. FIG. 4 shows what the square represented in FIG. 1 looks like when fully collapsed (formed). When fully collapsed, as in FIG. 4, triangles BJK, ACK and BDF move to the inside, leaving triangle CDE fully visible, and triangle FGH partially visible. Triangle FGH represents one side of the appendage, with the other represented by its corresponding mirror image. After collapsing, the square represented in FIG. 1 has four appendages and four hinges or folds.

The following instructions describe how to create, with four copies corresponding to each wedge, of the three dimensional structure distributed equally about the center point P of a square (the center point being defined as the intersection of two bisectors of the square), either one horizontal and one vertical, or two diagonal. The array of triangles is produced by folding a square sheet of paper as shown in FIGS. 5 through 16. As noted, these instructions produce four copies of the wedge of FIG. 2; for clarity we shall refer to these copies by ', ", '", and """. Several unnecessary folds are created during this procedure which are discussed hereinafter.

Figure 5:
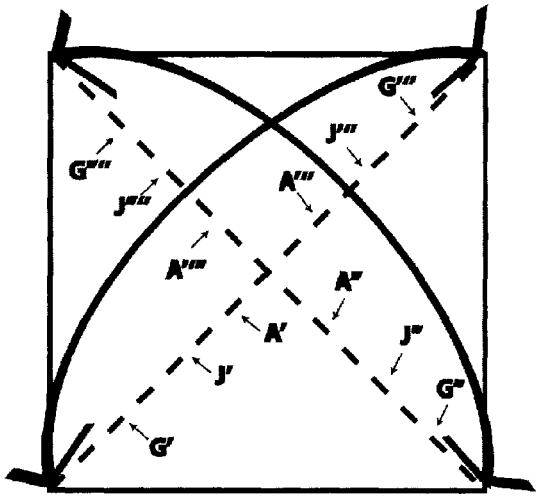
FIGS. 5-16 are successive diagrams illustrating the sequence of folds used to form a three dimensional structure from a square sheet material.

In FIG. 5 the square is valley folded and then unfolded diagonally in half in both directions. These folds of the square correspond to lines A', J', and G' as well as lines A", J", G"; A'", J'", G'"; and A"", J"", G"". It is noted that while the location of lines A, J, and G are shown (along the valley fold being performed), their beginning and end points are not shown in FIG. 5.

Figure 6:
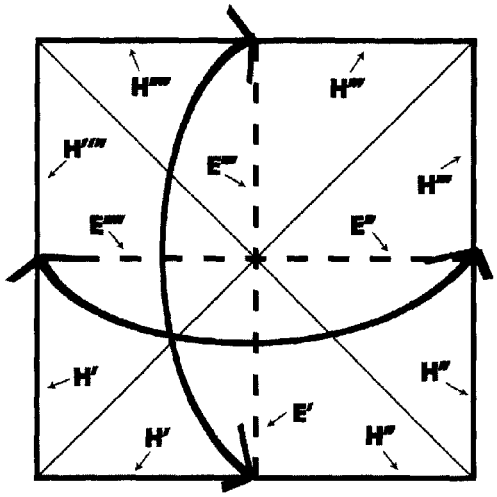
Figure 7:
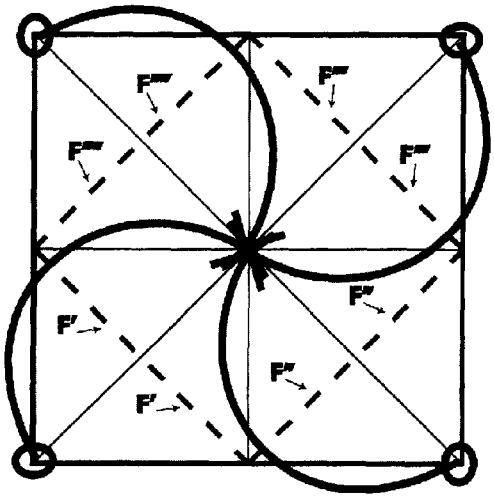
Figure 8:
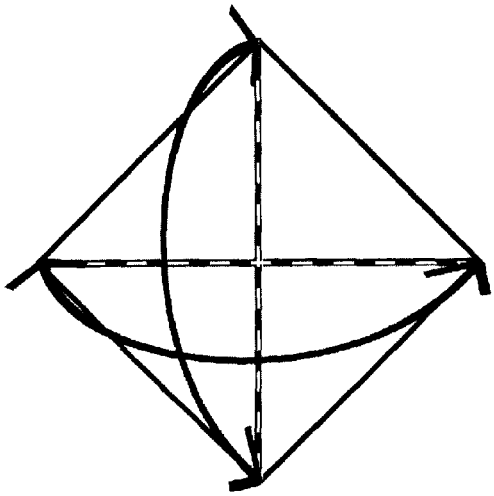
Figure 9:
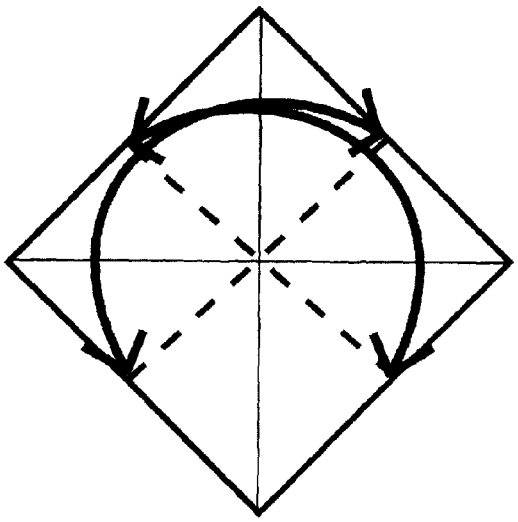

In FIG. 6 the square is flipped and valley folded and unfolded in half horizontally and vertically. These folds correspond to lines E', E", E'" and E"". The material edges H are also shown along with their corresponding mirrors, lines H', H", H'" and H"". In FIG. 7 each outside corner is valley folded to the center. These folds create F', F", F'", F"" as well as their mirror images on the opposite side of center line AJG. In FIG. 8 the model is folded and unfolded in half diagonally in both directions. In FIG. 9 the square is flipped and then folded in half horizontally and vertically. These folds are made to facilitate a collapse which follows. To collapse the square, flip it and then lift the center off your work surface by gently pinching the folds you just made and pushing slightly toward the center.

Figure 10:
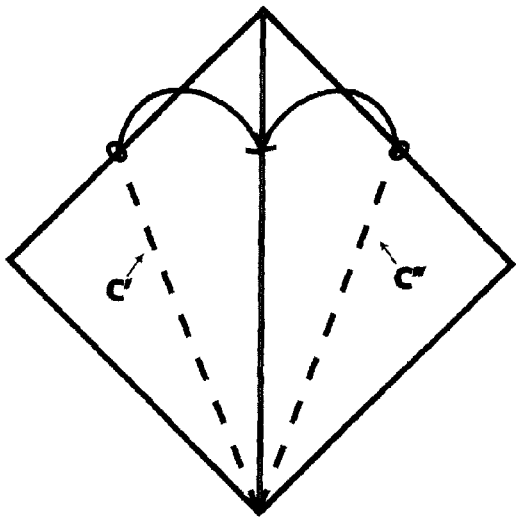
Figure 11:
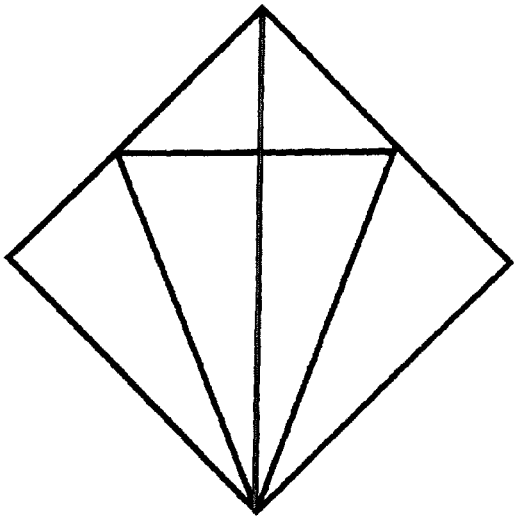
Figure 12:
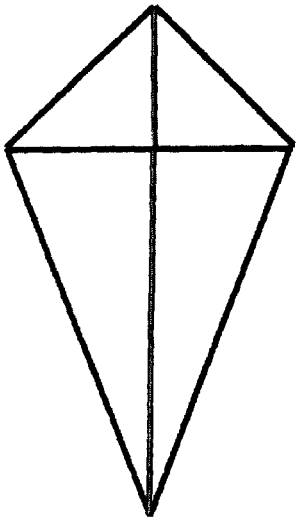
Figure 13:
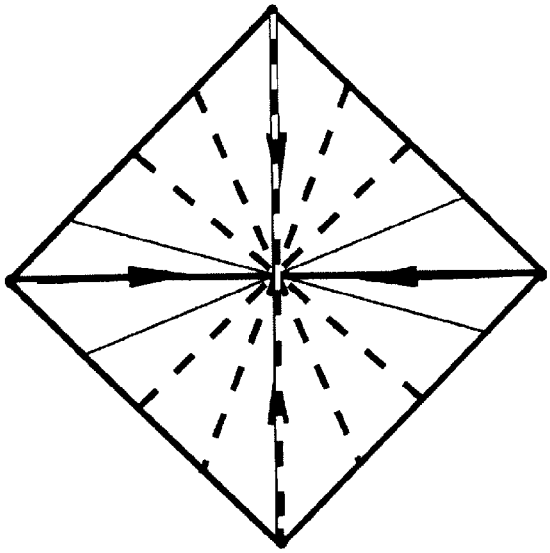
Figure 14:
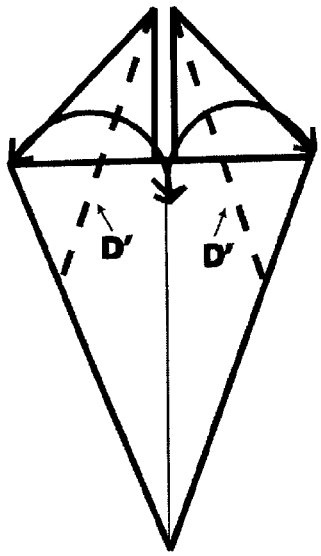

In FIG. 10 the square has been collapsed. With the open corners at the top, valley fold the left and right edges of the top layer (which is made up of 4 layers) of paper to the center. This fold creates C and its mirror image simultaneously. It is noted that the actual folds, C' and C" in FIG. 10 correspond to the two inner layers. The model now should look like FIG. 11. Flip it and repeat the folds from FIG. 10 on the other side. The folds performed in FIGS. 10 and 11 create folds C', C", C'", and C"" as well as their mirror images on the opposite side of center line AJG. The model now should look like FIG. 12. Unfold the folds you made in FIGS. 10 and 11. In FIG. 13 reverse folds as necessary and then collapse the model to produce the shape in FIG. 14. Valley fold and then unfold the outer corners to the center as shown in FIG. 14. Flip the model and do the same on the other side. Book-fold your model on both sides and repeat the folds on the other two sides. These folds create D', D", D'", and D"" as well as their mirror images on the opposite side of center line AJG and several unused folds.

Figure 15:
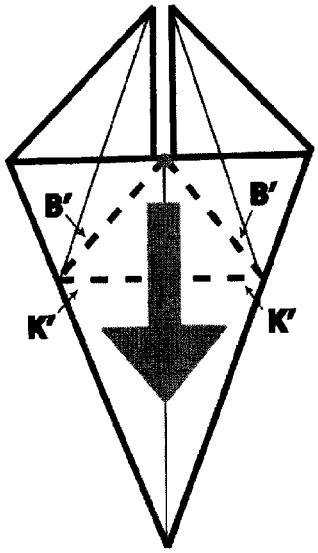
Figure 16:
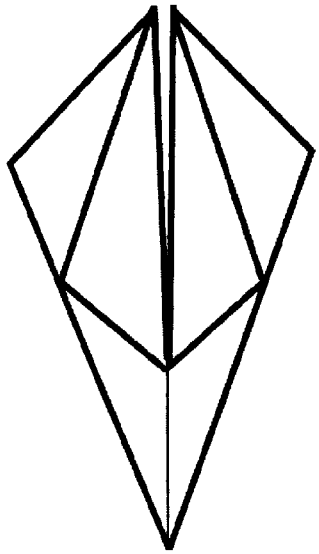

In FIG. 15, pull the center point of the edge down as shown and then flatten, thus creating two visible mountain folds and one hidden valley fold. The model now looks like FIG. 16. Flip the model and repeat on the opposite side, and then book-fold the model on both sides and repeat again on the other two sides. The mountain folds (one layer below the top layer) correspond to B' and it's mirror image on the opposite side of center line AJG. The hidden valley fold (one layer below the top layer) corresponds to K' and it's mirror image on the opposite side of center line AJG. This fold also creates several unused folds. Repeating this fold for all corresponding sides of the model thus creates B', B", B'", B"", K', K", K'", and K"". Completely unfold the model and it now looks similar to FIG. 1. Pinch and then push each corner toward the center and it will collapse as in FIGS. 3 and 4. The folded model contains unnecessary folds which result from the origami-style process of folding. Considering FIG. 2, the folds in the folded model within triangles FGH and BDF are unnecessary.

When G=A+J and when G=0 the invention will yield the same number of appendages as there are sides of the original polygon. For example, a square will yield four appendages and a pentagon will yield five. FIG. 17 shows an octagon where G>A+J. When G>A+J or G<A+J the resultant number of appendages is one half the number of sides of the original polygon.

In the embodiments discussed so far the number of wedges has been four. However, a greater or lesser number of wedges may be used in accordance with the principles of the present invention. For example, FIG. 18. shows a decagon which will produce five appendages and five hinges. In this example, $$\frac{360^\circ}{5} = 72^\circ$$

for each appendage, therefore $$\theta = \frac{72^\circ}{4} = 18^\circ.$$

Thus, one can make a shape with any number of appendages (P) as expressed by:

$$\theta = \frac{\frac{360^\circ}{P}}{4}$$

For example, to make a shape with 100 appendages, the angle θ would be calculated as:

$$\theta = \frac{\frac{360^\circ}{100}}{4} = 0.9^\circ$$

The principles of the present invention can be applied to conventional polygons, as well as unconventional polygons. Because G can be any value, from zero to infinity, one can modify the invention to suit specific purposes. In the example from FIG. 1, a square was used. In that example, G=A+J. There is no requirement that G be constant within the polygon, furthermore there is no requirement that H be a straight line. An example of this is shown in FIG. 19 wherein one of the appendages P1 is tear-shaped, or virtually any other shape or configuration.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A folding pattern of sheet material having multiple side edges wherein the sheet material is foldable to form a three dimensional structure, the folding pattern defined by a plurality of triangles each having joined sides, a diagonal demarcation line that separates the sheet material into separate but adjacent segments that each are a mirror image of the other, each segment being comprised of five adjacently disposed triangles, including a first triangle, a second triangle having one side in common with a side of the first triangle, a third triangle having one side in common with another side of the second triangle, a fourth triangle having one side in common with another side of the third triangle, and a fifth triangle having one side in common with another side of the fourth triangle.

2. The folding pattern of claim 1 wherein the first triangles of respective separate segments form a valley fold.

3. The folding pattern of claim 2 wherein the second and fifth triangles of each segment form respective valley folds.

4. The folding pattern of claim 3 wherein the third and fourth triangles form at least part of a mountain fold.

5. The folding pattern of claim 1 wherein the second and fifth triangles of each segment form respective valley folds.

6. The folding pattern of claim 1 wherein the third and fourth triangles form at least part of a mountain fold.

7. The folding pattern of claim 6 wherein the third and fourth triangles of both segments form a mountain fold.

8. The folding pattern of claim 1 wherein the same angle theta is formed at the fourth and fifth triangles measured from a centerpoint.

9. The folding pattern of claim 1 wherein the another side of the fourth triangle is equal in length to another side of the fifth triangle.

10. The folding pattern of claim 1 wherein the one side of the third triangle is equal in length to the one side of the fourth triangle.

11. The folding pattern of claim 1 wherein said plurality of triangles form a first wedge, and further including at least a second wedge that is substantially the same as the first wedge and is contiguous therewith.

12. The folding pattern of claim 11 including four wedges in a square pattern.

13. The folding pattern of claim 1 wherein the sheet material is one of paper, metal or some other material.

14. The folding pattern of claim 1 wherein the triangles are interconnected by one of folds and hinges.

15. A folding pattern of sheet material having multiple side edges wherein the sheet material is foldable to form a three dimensional structure, the folding pattern defined by a polygon shape with multiple wedges, each said wedge formed of a plurality of triangles each having joined sides, a diagonal demarcation line that separates the sheet material into separate but adjacent segments that each are a mirror image of the other, each the segment being comprised of five adjacently disposed triangles, including a first triangle, a second triangle having one side in common with a side of the first triangle, a third triangle having one side in common with another side of the second triangle, a fourth triangle having one side in common with another side of the third triangle, and a fifth triangle having one side in common with another side of the fourth triangle.

16. The folding pattern of claim 15 including at least a first wedge and at least a second wedge that is substantially the same as the first wedge and is contiguous therewith.

17. The folding pattern of claim 16 including four wedges in a square pattern.

18. The folding pattern of claim 17 wherein the four wedges have a common center point.

19. The folding pattern of claim 15 wherein the first triangles of respective separate segments form a valley fold, and the second and fifth triangles of each segment form respective valley folds, and the third and fourth triangles form at least part of a mountain fold.

20. The folding pattern of claim 15 wherein the third and fourth triangles form at least part of a mountain fold, and the third and fourth triangles of both segments form a mountain fold.

* * * * *